US005448009A

United States Patent [19]

Kudo

[11] Patent Number: 5,448,009

[45] Date of Patent: Sep. 5, 1995

[54] ELECTRONIC MUSICAL INSTRUMENT INCLUDING TONE GENERATOR CONTROLLER CAPABLE OF CONDUCTING EFFICIENT CONTROL ON DIFFERENT TYPES OF TONE GENERATORS

[75] Inventor: Masaki Kudo, Hamamatsu, Japan

[73] Assignee: Yamaha Corporation, Japan

[21] Appl. No.: 88,665

[22] Filed: Jul. 6, 1993

[30] Foreign Application Priority Data

Jul. 7, 1992 [JP] Japan ..... 4-202955

[51] Int. Cl.[6] ..... G10H 7/00; G10H 1/06

[52] U.S. Cl. ..... 84/602; 84/615; 84/622; 84/659

[58] Field of Search ..... 84/601, 602, 604, 615, 84/618, 622, 625, 631, 647, 653, 659, 660, 692, 697

[56] References Cited

U.S. PATENT DOCUMENTS 4,993,307 2/1991 Sakashita ..... 84/615
5,159,144 10/1992 Fujisawa et al. ..... 84/656
5,192,824 3/1993 Shibukawa ..... 84/615
5,200,565 4/1993 Satoshi et al. .
5,345,035 9/1994 Yamada ..... 84/622

FOREIGN PATENT DOCUMENTS 3-120593 5/1991 Japan .

*Primary Examiner*—Vit W. Miska
*Attorney, Agent, or Firm*—Graham & James

[57] ABSTRACT

A controller is arranged as a sub control unit between a CPU as a main control unit and a tone generator system. The main control unit outputs command data having a standard format as an instruction signal. The sub control unit generates and outputs instruction data as an instruction signal in a format according to the type of tone generator system on the basis of the command data. The tone generator system executes generation of a tone signal and processing associated with generation of the tone signal in accordance with the instruction data. The CPU can efficiently control tone generator systems of different types. Data transfer between the CPU and a plurality of tone generator systems of different types can be highly efficiently performed, and the processing load on the CPU can be reduced.

15 Claims, 5 Drawing Sheets

FIG. 1
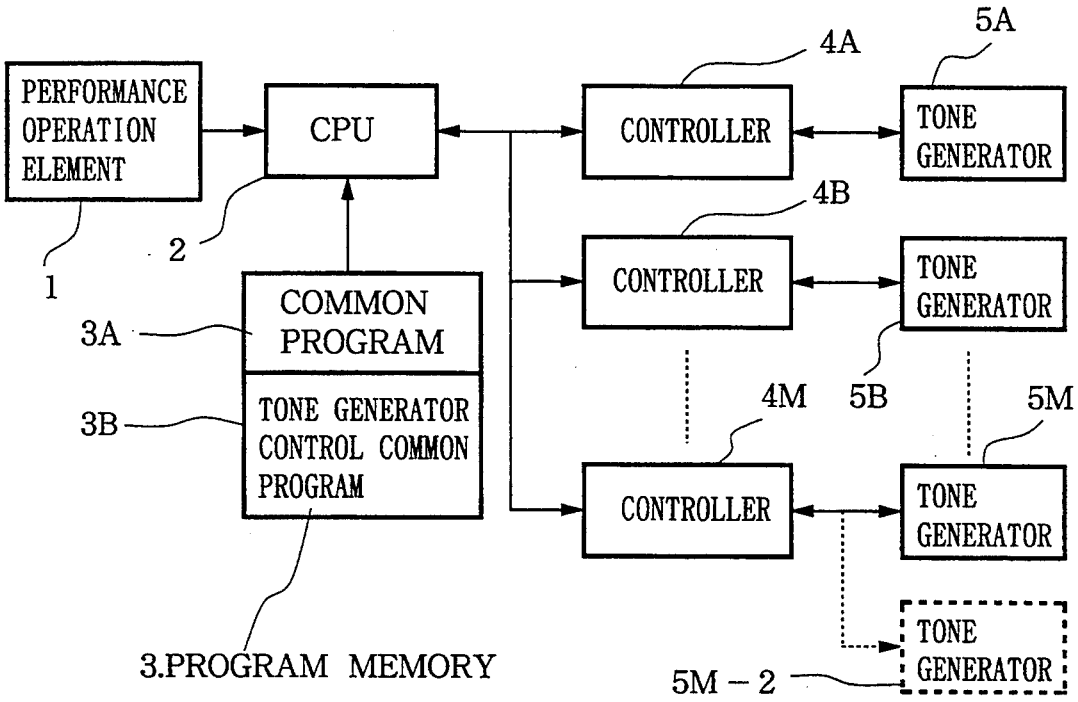
FIG. 2A
FORMAT OF COMMAND FROM CPU
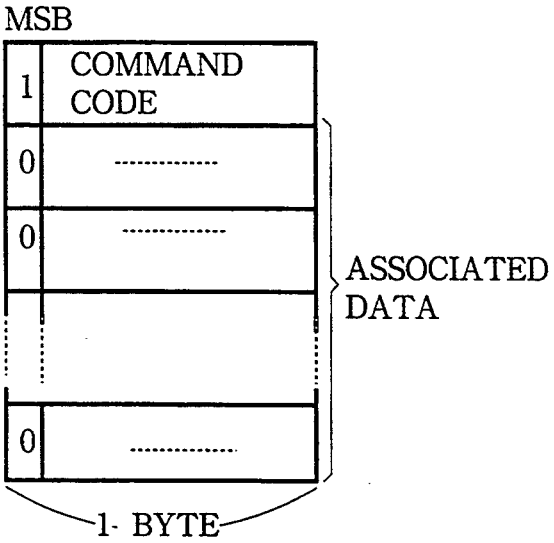
FIG. 2B
KEY ON COMMAND
| | | |
|---|---|---|
| 1 | KEYON | (TGC) |
| 0 | KC (KEY CODE) | |
| 0 | VEL (VELOCITY) | |
FIG. 2C
TONE COLOR SELECTION COMMAND
| | | |
|---|---|---|
| 1 | TCSEL | (TGC) |
| 0 | TCNO | |

| |
|---|
| SYSTEM DATA |
| TONE COLOR DATA TC1 |
| TONE COLOR DATA TC2 |
| ≀ |
| TONE COLOR DATA TCN |

| |
|---|
| SYSTEM INITIALIZATION DATA |
| KC→FNO CONVERSION TABLE |
| ≀ OTHER DATA |

ELECTRONIC MUSICAL INSTRUMENT INCLUDING TONE GENERATOR CONTROLLER CAPABLE OF CONDUCTING EFFICIENT CONTROL ON DIFFERENT TYPES OF TONE GENERATORS

BACKGROUND OF THE INVENTION

1. Field of the Invention

The present invention relates to an electronic musical instrument including a tone generator controller and, more particularly, to an electronic musical instrument including a tone generator controller, which can efficiently control tone generator systems of different types.

2. Description of the Related Art

In recent years, an electronic musical instrument mounts a plurality of tone generator systems of different types. Each of these tone generator systems normally comprises one or a plurality of LSIs, and is connected to a bus line together with a central processing unit (CPU) for controlling operations of the entire electronic musical instrument. The CPU detects an operation of a performance operation element such as a key of a keyboard, and supplies a tone generation instruction to the tone generator system in accordance with the detected operation. The CPU detects an operation of a panel switch, and supplies a tone color setting instruction to the tone generator system in accordance with the detected operation. The tone generator system generates a tone signal or changes and sets an internal tone color parameter according to an instruction from the CPU.

FIG. 7 shows a schematic arrangement of a conventional electronic musical instrument. This electronic musical instrument comprises a performance operation element 101, a CPU 102, a program memory 103, and tone generators 105A to 105M. The performance operation element 101 is operated by a player to generate a tone, and is, e.g., a keyboard for outputting performance information according to an operation of the player. The CPU 102 operates according to programs stored in the program memory 103. The tone generators 105A to 105M are tone generator systems of different types, which generate tone signals and set tone colors, and the like in accordance with instructions from the CPU 102. The tone generators 105A to 105M respectively have different interfaces since they are of different types. For example, when the CPU 102 instructs the tone generators 105A and 105B to generate tone signals, it uses different instruction formats.

The program memory 103 stores a common program 103' for controlling the entire electronic musical instrument, a control program 103A for the tone generator 105A, a control program 103B for the tone generator 105B, . . . , a control program 103M for the tone generator 105M.

The CPU 102 executes the common program 103' to detect performance information from the performance operation element 101 and to detect an operation of a panel switch (not shown). As described above, since the tone generators 105A to 105M are of different types of tone generators, the CPU 102 executes different processing for each of tone generators to supply corresponding instructions. For example, the CPU 102 executes the control program 103A for the tone generator 105A when it supplies an instruction to the tone generator 105A, executes the control program 103B for the tone generator 105B when it supplies an instruction to the tone generator 105B, . . .

In the above-mentioned prior art, when the CPU supplies an instruction to one of the tone generators, it executes the corresponding one of the control programs 103A to 103M. Therefore, the CPU must execute many steps for each of tone generators, thus lowering processing efficiency of the CPU.

On the other hand, paying attention to one tone generator, most of digital tone generator systems of electronic musical instruments in recent years realize polyphonic architectures by time-divisional multiplexing processing. Since the time-divisional multiplexing processing is executed, a tone generator operates at a processing timing asynchronous with the CPU and synchronous with a sampling frequency. A tone signal generation instruction or a tone color setting/changing instruction from the CPU is realized by transferring predetermined instruction data to a tone generator in practice. In this case, since a tone generator system as a receiving end of data operates at a unique processing timing, the CPU must perform data transfer while monitoring the condition of the tone generator system, resulting in troublesome, inefficient control.

For example, U.S. Pat. No. 5,200,565 discloses a system wherein when a new parameter (i.e., a read/write memory address) is written, the CPU must wait for one DAC cycle since the time-divisional multiplexing processing is performed. In this manner, since the tone generator operates at a unique processing timing, the CPU must wait when it reads/writes data, resulting in inefficient control.

SUMMARY OF THE INVENTION

It is an object of the present invention to provide an electronic musical instrument including a tone generator controller with which a CPU can efficiently control tone generator systems of different types.

It is another object of the present invention to provide an electronic musical instrument including a tone generator controller, with which data transfer between a CPU and tone generator systems of different types is highly efficiently performed, and the processing load on the CPU can be reduced.

An electronic musical instrument according to the first aspect of the present invention comprises: tone signal generation means including plural types of tone generators each of which generates a musical tone signal with a different tone production algorithm; main control means for generating an instruction which comprises generator identifying data and common control data, the generator identifying data identifying one of the plural types of tone generators and the common control data being common to the plural types of tone generators and designating tone property to be imparted to a musical tone corresponding to the musical tone signal; and sub control means, arranged between the main control means and the tone signal generation means, for receiving the instruction and converting the common control data to exclusive control data suitable for the identified tone generator, the identified tone generator generating a musical tone signal having the tone property in accordance with the exclusive control data and its algorithm.

An electronic musical instrument according to the second aspect of the present invention comprises: a plurality of tone signal generation means of different types for executing generation of a tone signal and processing associated with generation of the tone signal in accordance with an input instruction signal, the tone signal generation means operating according to instruction signals in different formats; main control means for generating and outputting an instruction signal in a standard format regardless of the types of the tone signal generation means; and a plurality of sub control means, arranged between the main control means and the tone signal generation means, and each corresponding to one of the plurality of tone signal generation means, each for receiving and decoding the instruction signal from the main control means, generating the instruction signal in a format, which can be recognized by the corresponding tone signal generation means, and outputting the generated instruction signal to the corresponding tone signal generation means.

The processing associated with generation of a tone signal in the tone signal generation means is, e.g., tone color setting processing. As the tone signal generation means, for example, means of a waveform memory reading type, an FM type, or a harmonic synthesizing type is used.

Furthermore, a single sub control means may control a plurality of tone signal generation means of a single type.

The main control means generates an instruction signal in a standard format regardless of the types of tone signal generation means, and outputs the generated instruction signal to the sub control means. The sub control means decodes the instruction signal, generates an instruction signal in a format which can be recognized by the corresponding tone signal generation means, and outputs the generated instruction signal. The tone signal generation means executes generation of a tone signal and the processing associated with generation of the tone signal in accordance with the instruction signal.

Since the sub control means is arranged between the main control means and the tone signal generation means, the main control means need only output an instruction signal to the sub control means, and need not monitor the condition of the tone signal generation means. The main control means can generate the instruction signal in the standard format, and need not generate a special instruction signal in consideration of the type of tone signal generation means. Thus, the processing load on the main control means is reduced.

BRIEF DESCRIPTION OF THE DRAWINGS

FIG. 1 is a schematic block diagram showing an electronic musical instrument according to an embodiment of the present invention;

FIGS. 2A to 2C are views showing formats of command data;

DETAILED DESCRIPTION OF THE PREFERRED EMBODIMENT

The preferred embodiment of the present invention will be described hereinafter with reference to the accompanying drawings.

Figure 7:
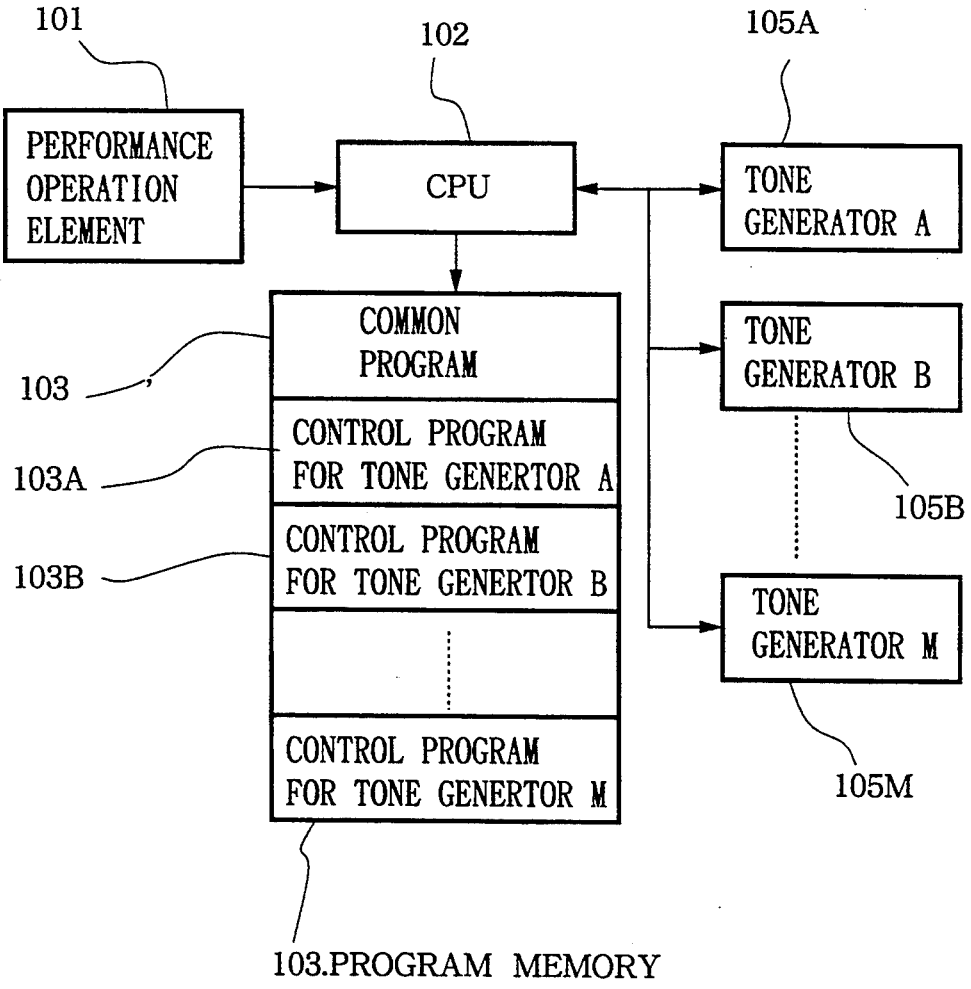
FIG. 7 PRIOR ART
FIG. 7 is a schematic block diagram showing a conventional electronic musical instrument.

FIG. 1 is a schematic block diagram showing an electronic musical instrument according to an embodiment of the present invention. This electronic musical instrument comprises a performance operation element 1, a central processing unit (CPU) 2, a program memory 3, controllers 4A to 4M, and tone generators 5A to 5M. The performance operation element 1 and the tone generators 5A to 5M are the same as the performance operation element 101 and the tone generators 105A to 105M in the prior art (FIG. 7), and the tone generators 5A to 5M are tone generator systems of different types.

The program memory 3 stores a common program 3A for controlling the entire electronic musical instrument and a control program 3B commonly used for the tone generators. In particular, as the characteristic feature of the electronic musical instrument of this embodiment, an instruction can be issued using the common control program 3B for the tone generators 5A to 5M of different types.

The CPU (main control means) 2 executes the common program 3A to detect performance of the performance operation element 1 and to detect an operation of a panel switch (not shown). The CPU 2 executes the control program 3B common to the tone generators, and generates command data (instruction signal) in accordance with the detected operation. The command data is supplied to the controllers 4A to 4M.

The command data has a standard format. For example, in the prior art, when tone signal generation instructions are supplied to tone generators of different types, since instruction formats are different from each other, the CPU must generate and output instruction commands and parameters inherent to the tone generators. In contrast to this, the CPU 2 of this embodiment generates and outputs command data in the standard format. Therefore, upon generation of instructions to the tone generators of different types, if the instructions are of the same type (e.g., a tone signal generation instruction or a tone color setting instruction), command data are generated and outputted in the same format (including different internal data).

The controllers (sub control means) 4A to 4M respectively correspond to the tone generators 5A to 5M. Each of the controllers 4A to 4M receives command data in the standard format supplied from the CPU 2. When the received command is an instruction to the tone generator connected to the controller, the controller decodes the command, and supplies instruction data (instruction signal) to the tone generator in a format unique to the tone generator.

Upon reception of the instruction, each of the tone generators (tone signal generation means) 5A to 5M executes processing according to the instruction data. The tone generators 5A to 5M are connected to a sound system (not shown), which receives tone signals generated from the tone generators 5A to 5M, and produces actual tones.

FIG. 2A shows the format of command data (instruction signal) outputted from the CPU 2. The command data includes a command code indicating the type of command, and some associated data. The first byte of the command data is a command code. The command code, has a most significant bit (MSB) set with "1". The following associated data has an MSB set with "0".

FIG. 2B shows an example of the format of a key ON command, i.e., command data for instructing generation of a tone signal. A command code having an MSB set with "1" includes code data KEYON indicating that this command data is to instruct a key ON operation, and a tone generator channel TGC. The tone generator channel TGC is data for specifying a channel to be subjected to the key ON operation. As associated data, a key code KC for specifying the pitch of a tone to be generated and a velocity VEL representing the key depression speed on the keyboard are attached.

FIG. 2C shows an example of the format of a tone color selection command, i.e., command data for setting a tone color in a certain channel. A command code having an MSB set with "1" includes code data TCSEL indicating that this command data is a tone color selection command, and a tone generator channel TGC. The tone generator channel TGC is data for specifying a channel to be subjected to tone color selection. As associated data, a tone color number TCNO for specifying a tone color is attached.

Figures 3, 4A, 4B:
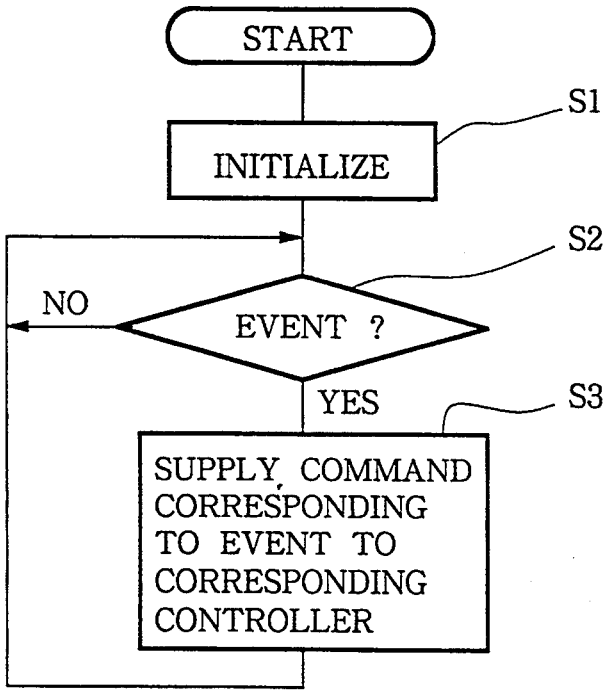
FIG. 3 is a flow chart for explaining the operation of a CPU.
FIG. 4A to 4B is a memory map of a parameter memory.

FIG. 3 is a flow chart for explaining the operation of the CPU 2 in the electronic musical instrument of this embodiment. In this electronic musical instrument, when a power switch is turned on, the respective units are initialized in step S1. In step S2, the presence/absence of an event is checked. The event includes all operation events which require supply of instructions to the tone generators, such as an operation of a performance operation element such as a keyboard, an operation of a tone color switch on a panel, and the like. When an event is detected, command data (data shown in FIGS. 2A to 2C) corresponding to the event is generated, and is supplied to the corresponding controllers 4A to 4M (step S3). Thereafter, the flow returns to step S2. If no event is detected in step S2, the flow also returns to step S2. Thereafter, processing from step S2 is repeated.

Note that the common program 3A on the program memory 3 in FIG. 1 mainly corresponds to steps S1 and S2 in FIG. 3, and the control program 3B common to the tone generators mainly corresponds to step S3 in FIG. 3.

The CPU 2 supplies command data to the controllers 4A to 4M by writing command data at a predetermined address. The controllers 4A to 4M are assigned with different addresses when viewed from the CPU 2. Therefore, the CPU 2 need only determine one of the controllers 4A to 4M (i.e., the tone generators 5A to 5M) to which command data is to be supplied, in accordance with the detected event, and write predetermined command data at the address of the determined controller.

The controllers 4A to 4M will be described below with reference to FIGS. 4 to 6.

Figure 5:
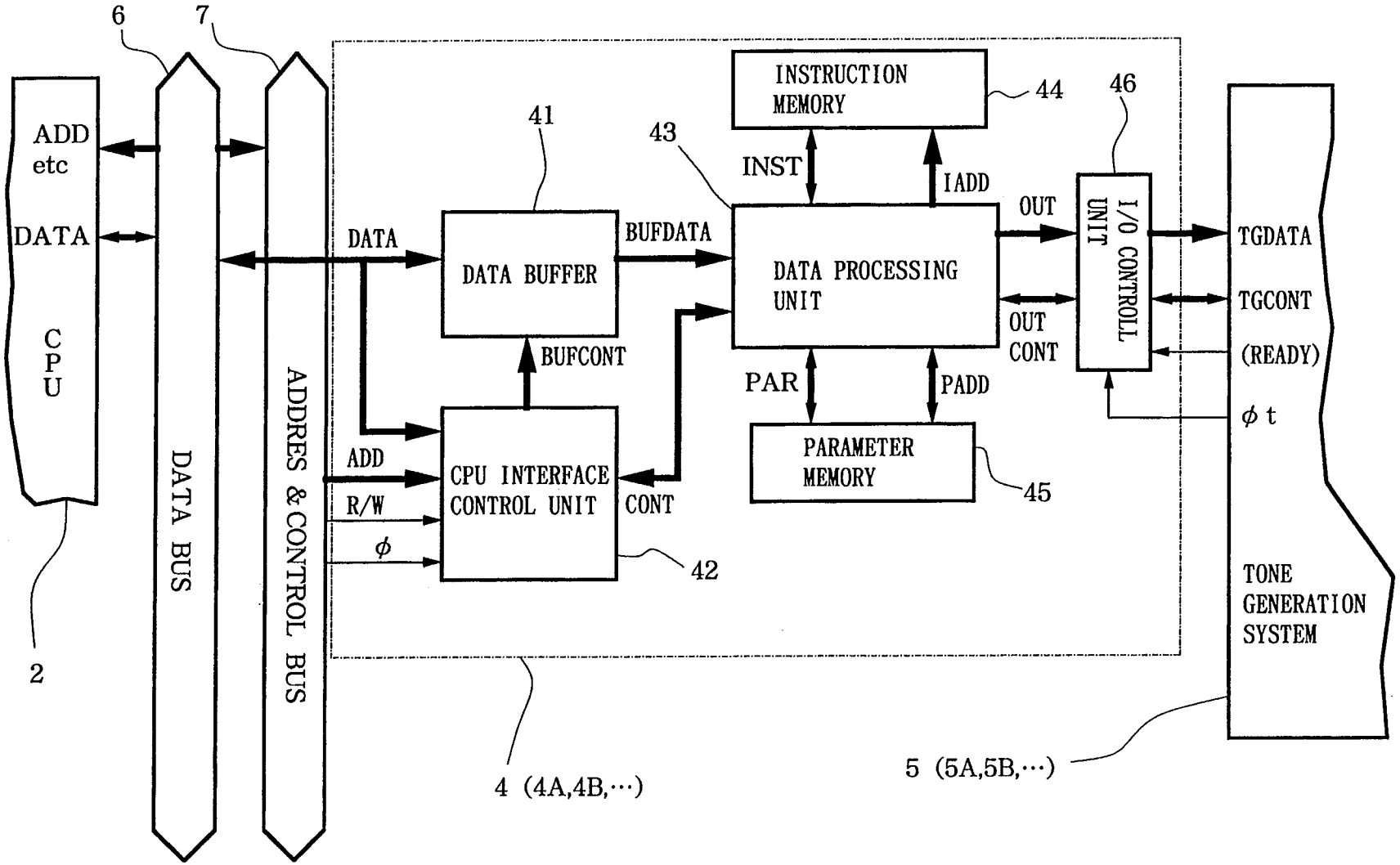
FIG. 5 is a block diagram showing an internal arrangement of a controller.
Figure 6:
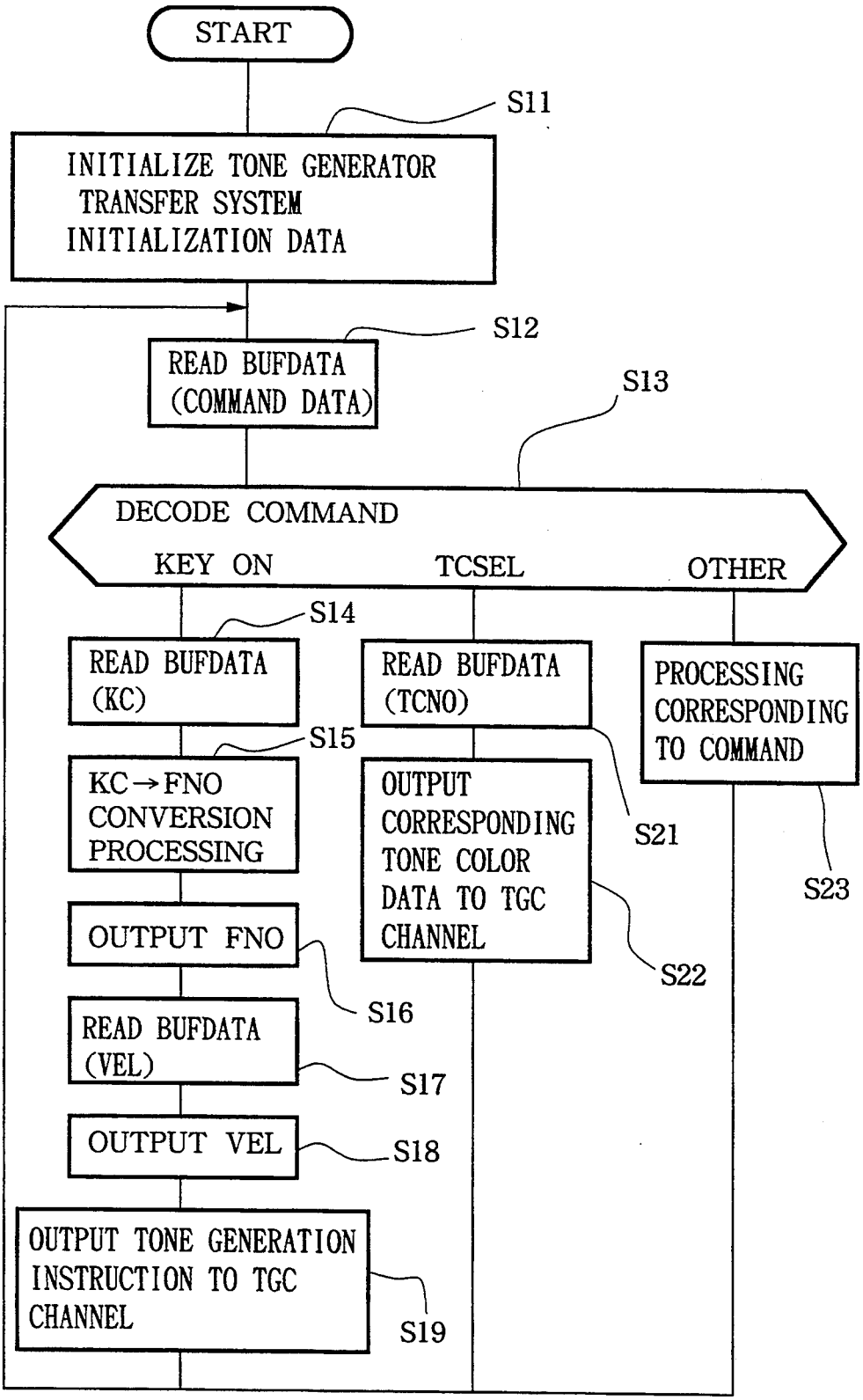
FIG. 6 is a flow chart for explaining the processing sequence of a data processing unit.

FIG. 5 is a block diagram showing an internal arrangement of a single controller 4. The controller 4 comprises a data buffer 41, a CPU interface control unit 42, a data processing unit 43, an instruction memory 44, a parameter memory 45, and an I/O control unit 46. The CPU 2 and the controller 4 are connected to each other via a data bus 6 and an address & control bus 7.

The CPU interface control unit 42 receives an address signal ADD and a read/write signal R/W from the CPU 2, and an operation clock signal $\phi$ of the CPU 2 via the address & control bus 7. The data buffer 41 and the CPU interface control unit 42 receive data DATA outputted from the CPU 2 via the data bus 6. The CPU interface control unit 42 is connected to the data bus 6 since the CPU 2 supplies a control command to the controller 4 and reads a status flag of the controller 4.

Command data (FIGS. 2A to 2C) supplied from the CPU 2 is stored in the data buffer 41. The data buffer 41 has a FIFO (First In First Out) architecture for reading/writing data in units of bytes. The data read/write access is performed based on a buffer control signal BUFCONT. For example, when the CPU 2 issues a command data write request (a write request to an address assigned to this controller) to the controller 4, the CPU interface control unit 42 recognizes the write request, and outputs the buffer control signal BUFCONT to store data from the data bus 6 in the data buffer 41. Thus, the command data supplied from the CPU 2 is stored in the data buffer 41.

The command data stored in the data buffer 41 is read out and processed by the data processing unit 43 in the order from the oldest one. When the data processing unit 43 reads out command data, the unit 43 outputs a predetermined data buffer access control signal CONT to the CPU interface control unit 42. The CPU interface control unit 42 outputs the buffer control signal BUFCONT in accordance with the data buffer access control signal CONT, so that one byte of command data (oldest data) in the data buffer 41 is read out and supplied to the data processing unit 43. Thus, the data processing unit 43 can acquire 1-byte data BUFDATA (command data) in the data buffer 41.

The data processing unit 43 executes a data processing sequence program stored in the instruction memory 44. The sequence will be described later with reference to the flow chart of FIG. 6. In order to read out (or write) the data processing sequence program, the data processing unit 43 supplies an instruction memory address (including a control signal) IADD to the instruction memory 44. The readout program is supplied to the data processing unit 43 via an instruction memory data bus INST.

The parameter memory 45 stores various parameters and associated data to be supplied from the controller 4 to a tone generator system 5 to be controlled. FIG. 4 shows the memory map of the parameter memory 45. As shown in FIG. 4A, the parameter memory 45 stores system data and tone color data TC1 to TCN. The system data includes system initialization data, as shown in FIG. 4B a KC→FNo conversion table, and other data.

The system initialization data is used when the power switch of this electronic musical instrument is turned on, and the controller 4 initializes the respective units therein. The KC→FNo conversion table is used when a key code KC is converted into a frequency number FNo. Since command data supplied from the CPU 2 to the controller 4 specifies a pitch using a key code KC, as shown in FIG. 2B, and instruction data from the controller 4 to the tone generator system 5 specifies a pitch using a frequency number FNo, the controller 4 must perform conversion. For this purpose, the KC→FNo conversion table is stored on the parameter memory 45.

The tone color data TC1 to TCN respectively represent tone colors having tone color numbers 1 to N. When the CPU 2 supplies a tone color selection command (FIG. 2C) to the controller 4, the controller 4 decodes the command, reads out tone color data TCi of the selected tone number from the parameter memory 45, and supplies the readout data to the designated channel of the tone generator system 5. In this manner, the tone color is set in the corresponding channel.

In order to read out (or write) data from the parameter memory 45, the data processing unit 43 supplies a parameter memory address (including a control signal) PADD to the parameter memory 45. The readout data is supplied to the data processing unit 43 via a parameter memory data bus PAR.

The data processing unit 43 reads command data from the data buffer 41, decodes the command, and executes corresponding calculations and control. Reference symbol OUT denotes output data outputted from the data processing unit 43 to the tone generator system 5. Reference symbol OUTCONT denotes a control signal between the data processing unit 43 and the I/O control unit 46. The I/O control unit 46 has a versatile I/O port such as a versatile one-chip microcomputer, whose function can be set by a program (instruction). Therefore, the I/O control unit 46 can be set to operate based on a program corresponding to the type of the tone generator system 5, so that the output data OUT is outputted as instruction data TGDATA in correspondence with the type of the tone generator system 5 in accordance with the OUTCONT.

The I/O control unit 46 outputs the output data OUT from the data processing unit 43 as instruction data TGDATA synchronized with the processing timing of the tone generator system 5. Reference symbol TGCONT denotes a control signal between the controller 4 (especially, the I/O control unit 46) and the tone generator system 5. Reference symbol READY denotes a signal outputted when the tone generator system 5 is ready to receive data. This signal READY is not prepared in some tone generator systems. In such a system, a predetermined time interval (one DAC time) is normally set between data transfer operations. When such a data transfer sequence is adopted, the controller 4 executes sequence control.

The tone generator system 5 executes generation of a tone signal and various processing associated therewith according to the inputted instruction data TGDATA. A tone generator of an arbitrary type may be used. For example, tone generators of the following types are used.

① Waveform Memory Reading Type

A tone generator of this type is also called a simple PCM type. A tone generator system includes a waveform memory, and reads out waveform data therefrom to generate a tone signal. Instruction data TGDATA to be transferred to the tone generator mainly includes waveform data address information, information associated with a filter, EG (envelope generator) parameters, and the like.

② FM (Frequency Modulation) Type

In a tone generator of this type, various tone waveforms are generated by changing the read-out speed or order of data from a memory which stores sine wave data. So-called operators are properly combined to obtain an arbitrary tone color. Instruction data TGDATA to be transferred to the tone generator mainly includes information associated with the frequencies or the frequency ratio of modulation waves or carrier waves, amplitudes, feedback amounts, EG parameters, and the like.

③ Harmonic Synthesizing Type

Instruction data TGDATA to be transferred to the tone generator includes the frequencies or amplitude coefficients in each of harmonics, parameters associated with the EG or filters, and the like.

In addition to the above-mentioned information, information to be transferred includes key ON/key OFF control information, the pitches and tone volumes, tone color selection, real time control data, and the like regardless of the types of tone generators. These data are transferred from the CPU 2 to the tone generator 5 via the controller 4 in response to each event.

The processing sequence of the data processing unit 43 will be described below with reference to the flow chart of FIG. 6. The flow chart of FIG. 6 shows the outline of the processing sequence program stored in the instruction memory 44.

When the power switch of this electronic musical instrument is turned on, the data processing unit 43 initializes the tone generator system 5 in step Sll. This initialization is performed by transferring the system initialization data (FIG. 4) in the parameter memory 45 to the tone generator system 5. In step S12, the data processing unit 43 reads 1-byte command data from the data buffer 41. As described above, since the data buffer 41 has the FIFO architecture, the oldest one of command data stored in the data buffer 41 at that time is read by the data processing unit 43.

The data processing unit 43 then decodes and discriminates the read command data in step S13. If it is determined that the command data is a key ON command (FIG. 2B), the flow advances to step S14; if it is determined that the command data is a tone color selection command (FIG. 2C), the flow advances to step S21; and if it is determined that the command data is another command, the flow advances to step S23.

If the read command data is a key ON command, another 1-byte data is read from the data buffer 41 in step S14. As can be seen from FIG. 2B, the data read in step S14 is a key code KC. In step S15, the key code KC is converted into a frequency number FNo. Upon conversion, the KC→FNo conversion table shown in FIG. 4 is used. In step S16, the frequency number FNo is outputted to a TGC channel designated by the command data (data read in step S12) of the tone generator system 5.

In step S17, still another 1-byte data is read from the data buffer 41. As can be seen from FIG. 2B, data read in step S17 is a velocity VEL. In step S18, the velocity VEL is outputted to the designated TGC channel of the tone generator system 5. In step S19, a tone generation instruction is outputted to the designated TGC channel. Thus, the corresponding channel of the tone generator system 5 executes generation of a tone signal. Thereafter, the flow returns to step S12.

If the command data read in step S12 is a tone color selection command, another 1-byte data is read from the data buffer 41 in step S21. As can be seen from FIG. 2C, the data read in step S21 is a tone color number TCNO. In step S22, tone color data of the tone color number TCNO is read out from the parameter memory 45 (FIG. 4), and is outputted to the designated TGC channel. Thus, the selected tone color is set in the designated TGC channel of the tone generator system 5. Thereafter, the flow returns to step S12.

If it is determined in step S13 that the command data is another command, processing corresponding to the command is similarly executed in step S23, and the flow returns to step S12.

As described above, the data processing unit 43 repeats the reading operation of command data from the data buffer 41, and execution of processing according to the read command.

According to the above embodiment, when the CPU 2 issues an instruction to a tone generator, it need only output command data to its controller 4. Since the command data can be generated in the standard format, the CPU 2 need not execute different control program for each of tone generators, and can generate command data using the control program common to all the tone generators. Therefore, the amount of processing conventionally executed by the CPU 2 in each of tone generators can be reduced, the tone generator processing of the CPU 2 can be simplified, and processing efficiency can be improved. For this reason, the CPU 2 can be exclusively engaged with another processing, e.g., scan processing of the performance operation element and the panel switch.

Since the controller 4 (especially, the data buffer 41) is arranged between the CPU 2 and the tone generator system 5, the CPU 2 can issue an instruction to the tone generator regardless of the processing timing of the tone generator system 5. More specifically, when the CPU 2 issues an instruction to the tone generator system 5, it need only supply command data to the controller 4 regardless of the processing timing.

In this embodiment, the instruction memory 44 and the parameter memory 45 shown in FIG. 5 may comprise either a RAM or ROM. When these memories comprise a RAM, data to be stored can be supplied from the CPU 2 and can be stored in these memories 44 and 45 during initialization. Similarly, the program to be executed by the I/O control unit 46 may be set by the CPU 2 during initialization. In this manner, the controller 4 can have a versatile hardware arrangement.

In this embodiment, a single controller 4 controls a single tone generator system 5. However, a single controller 4 can control a plurality of tone generator systems. For example, in FIG. 1, the controller 4M may control two tone generator systems, i.e., the tone generator systems 5M and 5M-2. In this case, when the tone generator systems to be controlled need be controlled independently, information for designating a tone generator system to be controlled can be added to command data from the CPU 2. For example, the tone generator systems 5M and 5M-2 can have different channel numbers TGC. In particular, when various tone generator systems are to be controlled, a controller is provided for each of types of tone generators, thus realizing efficient control.

The CPU 2 or tone generator may serve as a controller 4.

In the above embodiment, when the CPU 2 writes command data at a predetermined address, the data is transferred to the controller 4 corresponding to the address. Alternatively, command data may be written in all the controllers, and each controller itself may determine if the command is issued thereto.

Furthermore, the present invention is not limited to the above embodiment, and may be applied to an electronic musical instrument including a single CPU and a single tone generator.

As described above, according to the present invention, the sub control means is arranged, and an instruction from the main control means is decoded by the sub control means to output an instruction to the tone signal generation means. For this reason, the main control means can highly efficiently control tone signal generation means of various types, and the processing load on the main control means can be reduced. In addition, the main control means need only execute control processing common to a plurality of tone signal generation means of different types.

What is claimed is:

1. An electronic musical instrument comprising:

tone signal generation means including plural types of tone generators each of which generates a musical tone signal with a different tone production algorithm;

main control means for generating an instruction which comprises generator identifying data and common control data, said generator identifying data identifying one of said plural types of tone generators and said common control data being common to said plural types of tone generators and designating tone property to be imparted to a musical tone corresponding to said musical tone signal; and sub control means, arranged between said main control means and said tone signal generation means, for receiving said instruction and converting said common control data to exclusive control data suitable for said identified tone generator, said identified tone generator generating a musical tone signal having said tone property in accordance with said exclusive control data and its algorithm.

2. An instrument according to claim 1, wherein said main control means operates at an operation timing independent of an operation timing of said tone signal generation means.

3. An instrument according to claim 1, wherein said tone property is a tone color.

4. An instrument according to claim 1, wherein said tone property is a pitch of said musical tone.

5. An instrument according to claim 1, wherein said tone property is such a velocity as corresponds to keyboard's key depression speed, force or pressure.

6. An instrument according to claim 1, wherein said main control means includes a program memory storing a common program for controlling all or most of said electronic musical instrument and a tone generating control program which can be commonly used to said plural types of tone generators, and a central processing unit for controlling said all or most of said electronic musical instrument in accordance with said common program and for generating said instruction in accordance with said tone generating control program.

7. An instrument according to claim 1, wherein said sub control means comprises:

a memory for receiving said instruction from said main control means;

data processing means for reading out said instruction from said memory, and executing processing according to said instruction, thereby generating said exclusive data to said identifyed tone generator;

an instruction memory, connected to said data processing means via an instruction bus, for storing instruction codes to be executed by said data processing means; and a parameter memory, connected to said data processing means via a parameter memory bus, for storing parameters included in said exclusive data.

8. An instrument according to claim 1, wherein said sub control means further comprises input/output control means for receiving said exclusive data and transferring said exclusive data to said identified tone generator at a timing synchronous with an operation timing of said identified tone generator.

9. An electronic musical instrument comprising:

a plurality of tone signal generation means of different types for executing generation of a tone signal and processing associated with generation of the tone signal in accordance with an input instruction signal, said tone signal generation means operating according to instruction signals in different formats;

main control means for generating and outputting an instruction signal in a standard format regardless of the types of said tone signal generation means; and a plurality of sub control means, arranged between said main control means and said tone signal generation means, and each corresponding to one of said plurality of tone signal generation means, each for receiving and decoding the instruction signal from said main control means, generating the instruction signal in a format, which can be recognized by the corresponding tone signal generation means, and outputting the generated instruction signal to the corresponding tone signal generation means.

10. An instrument according to claim 9, wherein said main control means operates at an operation timing independent of an operation timing of said tone signal generation means.

11. An instrument according to claim 9, wherein the processing associated with generation of the tone signal in said tone signal generation means is tone color setting processing.

12. An instrument according to claim 9, wherein said tone signal generation means are a plurality of tone generator systems of different types.

13. An instrument according to claim 9, wherein said main control means includes a central processing unit for controlling the entire electronic musical instrument, and a program memory storing a program to be executed by said central processing unit, and said program memory stores a common program for controlling the entire electronic musical instrument, and a tone generator control program, which can be commonly used regardless of the types of said tone signal generation means.

14. An instrument according to claim 9, wherein each of said plurality of sub control means comprises:

a memory for receiving command data as the instruction signal from said main control means;

data processing means for reading out command data from said memory, and executing processing according to the command data, thereby generating and outputting instruction data as the instruction signal to the corresponding tone signal generation means; an instruction memory, connected to said data processing means via an instruction bus, for storing instruction codes to be executed by said data processing means; and a parameter memory, connected to said data processing means via a parameter memory bus, for storing parameters included in the instruction data to be outputted from said data processing means to the corresponding tone signal generation means.

15. An instrument according to claim 14, wherein each of said plurality of sub control means further comprises input/output control means for receiving the instruction data outputted from said data processing means, and transferring the instruction data to the corresponding tone signal generation means at a timing synchronous with an operation timing of the corresponding tone signal generation means.

* * * * *